US005961021A

United States Patent [19]

Koike et al.

[11] Patent Number: 5,961,021

[45] Date of Patent: Oct. 5, 1999

[54] AMPULE SEPARATOR

[75] Inventors: Naoki Koike; Hiroyuki Taniguchi; Yasuhiro Shigeyama, all of Toyonaka, Japan

[73] Assignee: Kabushiki Kaisha Yuyama Seisakusho, Toyonaka, Japan

[21] Appl. No.: 08/953,230

[22] Filed: Oct. 17, 1997

[30] Foreign Application Priority Data

Oct. 22, 1996 [JP] Japan ..... 8-279186
Jun. 7, 1997 [JP] Japan ..... 9-149061

[51] Int. Cl.[6] ..... B26F 3/02

[52] U.S. Cl. ..... 225/103; 225/97

[58] Field of Search ..... 225/4, 5, 93, 97, 225/103, 106

[56] References Cited

U.S. PATENT DOCUMENTS 3,099,375 7/1963 Schoppe et al. ..... 225/97
3,897,183 7/1975 Hofmann et al. ..... 225/103 X
4,462,526 7/1984 Dumont et al. ..... 225/4
5,076,555 12/1991 Bunch, Jr. ..... 225/4 X

*Primary Examiner*—Eugenia A. Jones
*Attorney, Agent, or Firm*—Wenderoth, Lind & Ponack, L.L.P.

[57] ABSTRACT

An ampule separator which can efficiently cut off ampules from a strip of series-connected plastic ampules. A strip of series-connected plastic ampule is put in a stocker having an outlet at its bottom, with the individual ampules arranged horizontally. A pair of horizontally arranged rotors are provided under the outlet of the stocker. Each rotor is formed, in its outer peripheral surface, with a groove in which the body of a plastic ampule can be partially received. As the rotors are rotated, the lowermost one of the plastic ampules is received in the grooves. As the rotors are rotated further, the ampule in the grooves is pushed down and cut off along a cutoff line formed between this and the immediately upper ampules by the rear edges of the grooves, with the upper ampules supported on cylindrical outer surfaces of the rotors.

8 Claims, 6 Drawing Sheets

AMPULE SEPARATOR

BACKGROUND OF THE INVENTION

This invention relates to an ampule separator for separating a strip of series-connected plastic ampules into individual ampules.

Unexamined Japanese utility model publication 5-86873 and Examined Japanese utility model publication 6-14753 disclose ampule dispensers which can discharge a required number of ampules stored therein one by one.

Ampules discharged from such ampule dispensers are made of plastics or glass.

As seen in FIGS. 7A and 7B, a plastic ampule comprises a body a filled with an injection fluid and a tab d having a cap c which is and integrally connected to the body through a cutoff line b. By twisting the tab, the tab can be separated from the body and thereby the top of the body can be opened.

A plurality of such plastic ampules A1 are integrally series-connected together through a thin cutoff line B provided between adjacent ampules.

In order to discharge a strip A0 of series-connected plastic ampules as shown in FIGS. 7A and 7B from an ampule dispenser, individual plastic ampules A1 have to be separated from each other along the cutoff lines B.

Plastic ampules A1 are separated either manually or mechanically.

It takes a lot of trouble and time to manually separate ampules. Mechanical means for separating ampules need, besides a cutter for cutting off ampules when a strip of ampules is stopped, a stopper for stopping the ampule strip at a predetermined position. Such means are naturally complicated in structure. Moreover, such means need a complicated control unit to actuate the stopper and the cutter in a coordinated manner.

An object of this invention is to provide an ampule separator which is simple in structure, and which can mechanically and efficiently cut off ampules from a strip of series-connected plastic ampules.

SUMMARY OF THE INVENTION

According to this invention, there is provided an ampule separator for separating a strip of series-connected plastic ampules along cut off lines provided between the adjacent ampules. The ampule separator comprises a stocker having an outlet for storing the strip of series-connected ampules therein so that the ampule at one end of the strip is discharged first from the outlet. A pair of rotors are provided opposite to each other at the outlet of the stocker, and a drive means is provided for rotating the rotors synchronously in opposite directions peripheral surface thereof, a groove formed to receive part of a body of one of the ampules.

The rear edge of each groove may extend straight in parallel to the axis of the respective rotor or may be twisted.

The twisted rear edges make it possible to push down a plastic ampule not at one time but gradually from one toward the other end of the ampule when the ampule is cut. The ampule can thus be cut off more reliably.

Other features and objects of the present invention will become apparent from the following description made with reference to the accompanying drawings, in which:

DETAILED DESCRIPTION OF THE PREFERRED EMBODIMENT

Now the embodiment of this invention is described with reference to FIGS. 1 to 6.

Figure 1:
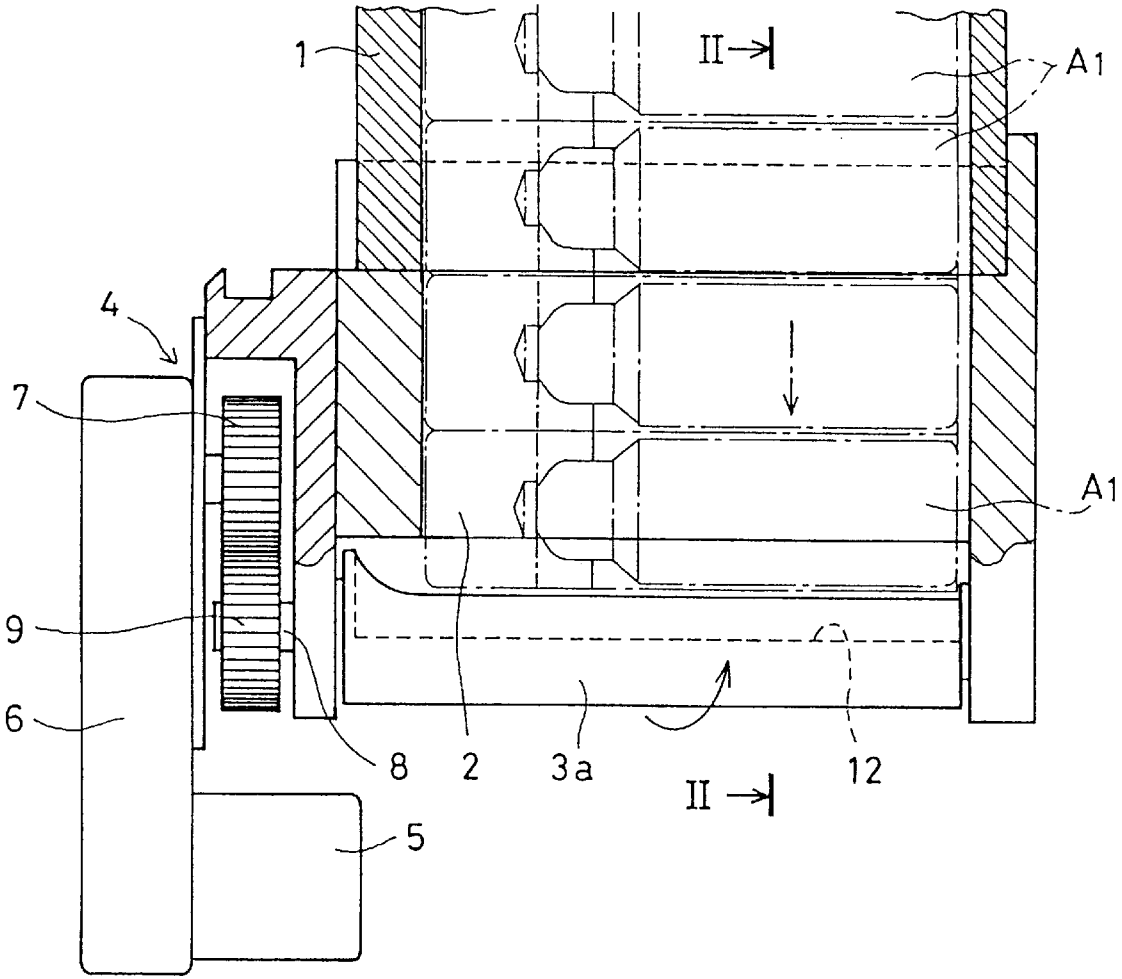
FIG. 1 is a front view in vertical section of an embodiment of this invention.
Figure 2:
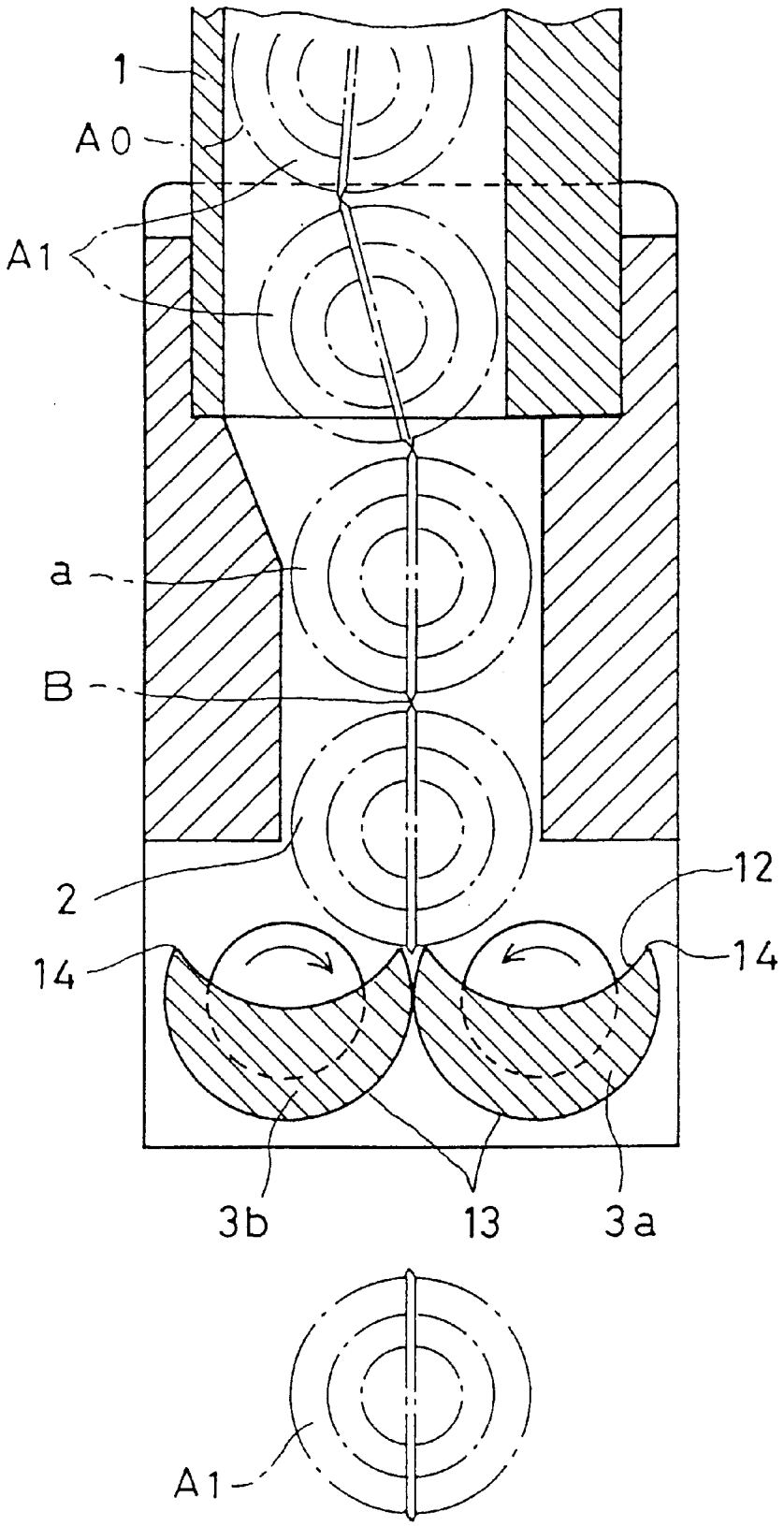
FIG. 2 is a sectional view taken along line II—II of FIG. 1.
Figure 3:
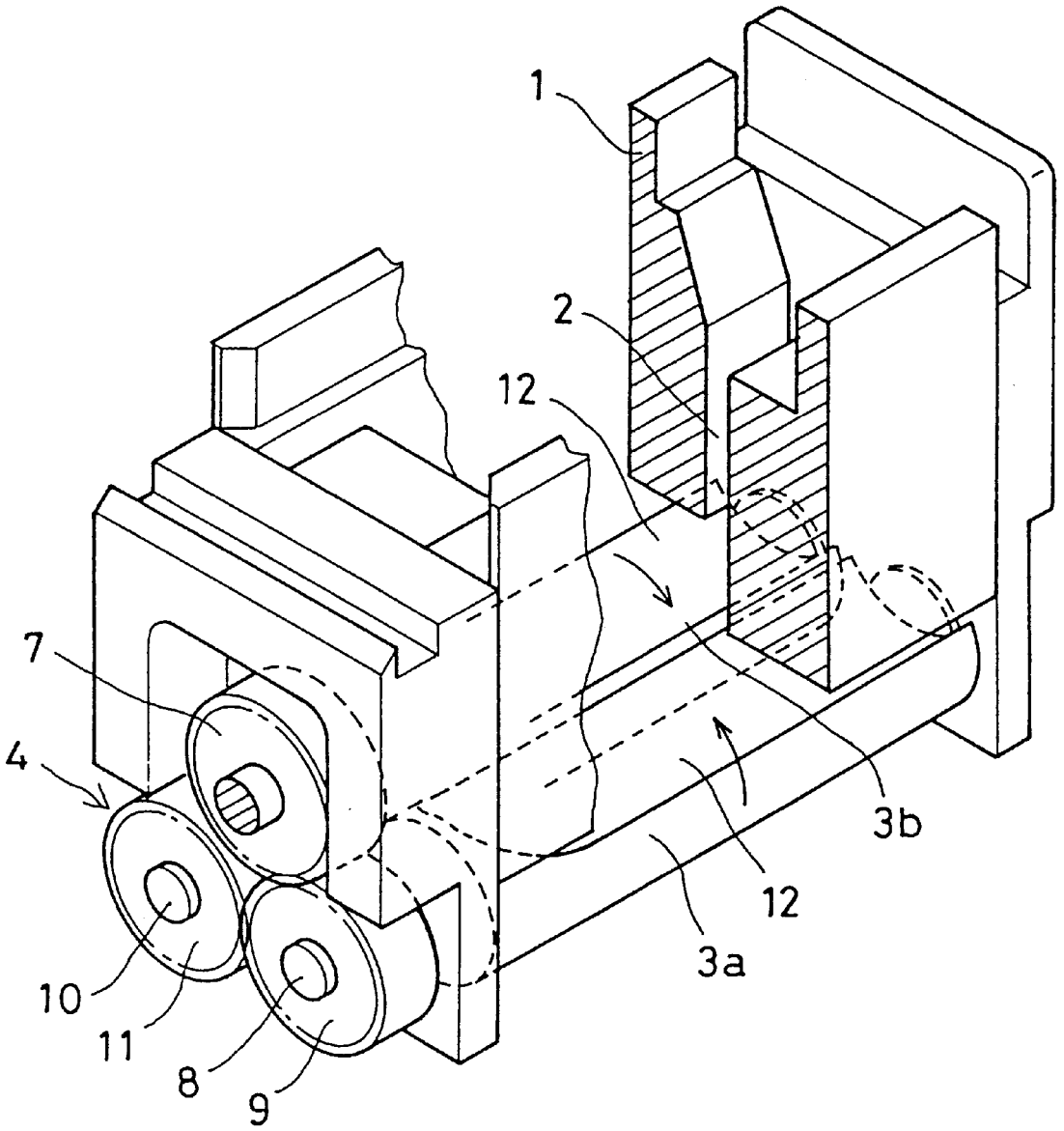
FIG. 3 is a partially cutaway perspective view of the lower portion of the stocker.

In FIGS. 1 to 3, a tubular stocker 1 is shown. Strips A0 of series-connected plastic ampules A1 are stored in the stocker 1 with the individual ampules arranged one upon another.

The stocker 1 has an outlet 2 at its bottom. Under the outlet 2 are a pair of horizontally arranged columnar rotors 3*a*, 3*b* rotated by a driving unit 4.

The driving unit 4 includes a motor 5 and a speed reducer 6 having an output shaft carrying a drive gear 7 in mesh with a first gear 9 mounted on a rotor shaft 8 of the rotor 3*a*. The first gear 9 is thus rotated by the motor 5 through the speed reducer 6. Since the first gear 9 is in mesh with a second gear 11 mounted on a rotor shaft 10 of the rotor 3*b*, the rotors 3*a*, 3*b* are rotated in opposite directions by the motor 5 as shown by arrows in FIG. 2.

Formed in the outer periphery of each of the rotors 3*a* and 3*b* is a groove 12 in which a plastic ampule A1 can be partially received. The grooves 12 are semi-cylindrical and define a space in which an entire plastic ampule can be received when the grooves 12 of two rotors confront each other.

With strips A0 of series-connected ampules received in the stocker 1, the drive unit 4 is actuated to rotate the rotors 3*a*, 3*b* in opposite directions. In this state, the cylindrical outer surfaces 13 of the rotors 3*a*, 3*b* come into contact with the body a of the-lowermost one of the ampules of the strip A0, thereby preventing the fall of the strip A0.

As the rotors further rotate, the cylindrical outer surfaces 13 will separate from the outer surface of the body a, and the grooves 12 move into opposition to the body of the ampule, so that the body begins partially slipping into the grooves 12. When the grooves 12 of two rotors 3*a*, 3*b* are positioned opposite to each other, the lowermost plastic ampule A1 will be entirely received in the space defined by the grooves 12.

As the rotors 3*a*, 3*b* further rotate from this state, with the second lowest plastic ampule A1 of the strip A0 supported on the cylindrical outer surfaces 13 of the rotors 3*a*, 3*b*, rear (relative to the rotating directions of the respective rotors) edges 14 of the grooves 12 will push down the body of the lowermost plastic ampule A1, thus cutting off or seperating the lowermost plastic ampule A1 along the cutoff line B.

In this way, the plastic ampules A1 of the ampule strip A0 are cut off one by one with each rotation of the rotors 3*a*, 3*b*, and the seperated ampule is discharged downward.

Figure 4:
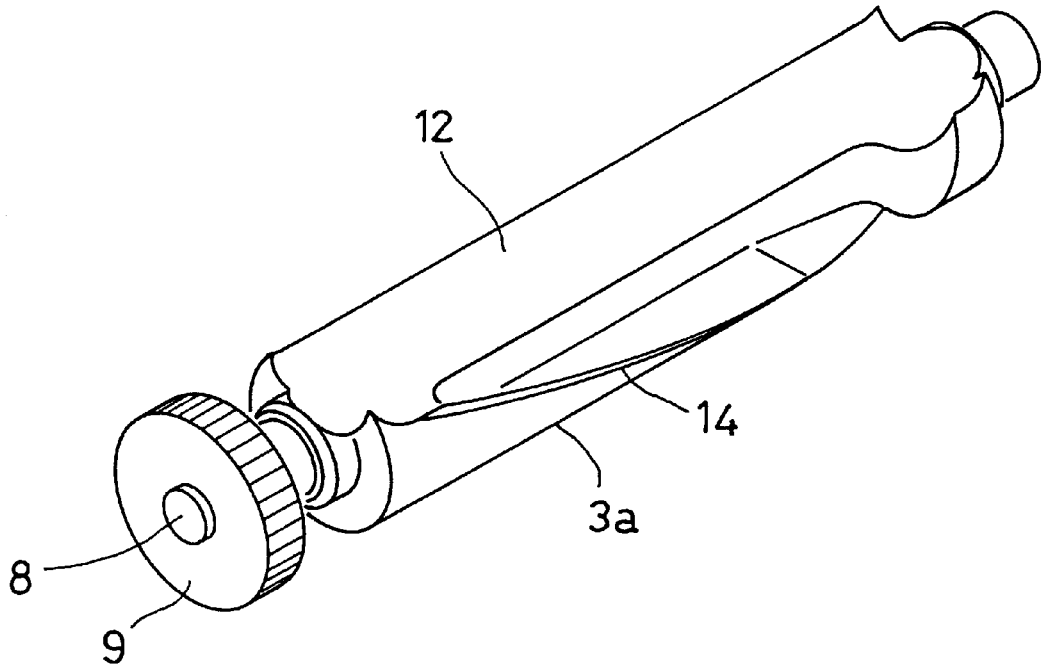
FIG. 4 is a perspective view of rotors of a different type.
Figure 5:
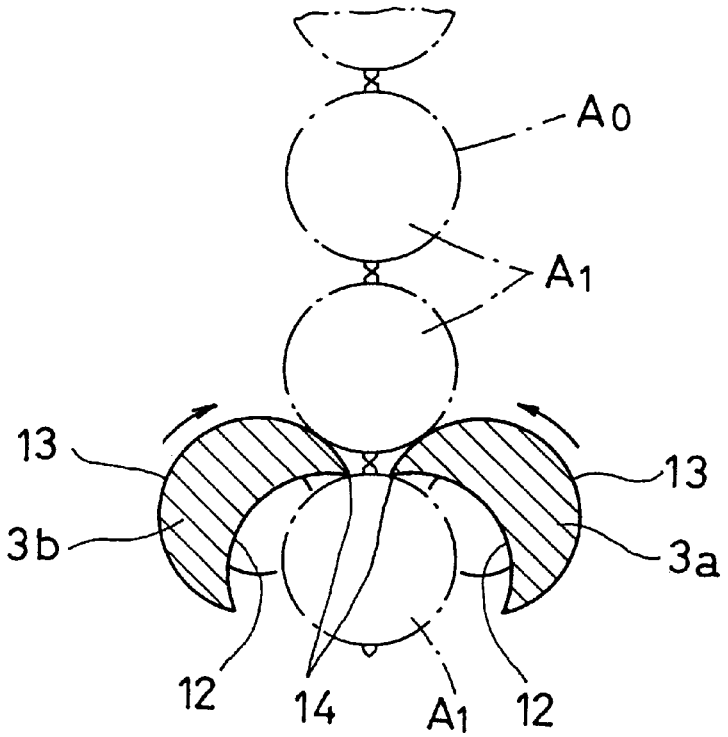
FIG. 5 is a sectional view of series-connected plastic ampules showing how one of them is cut off.
Figure 6:
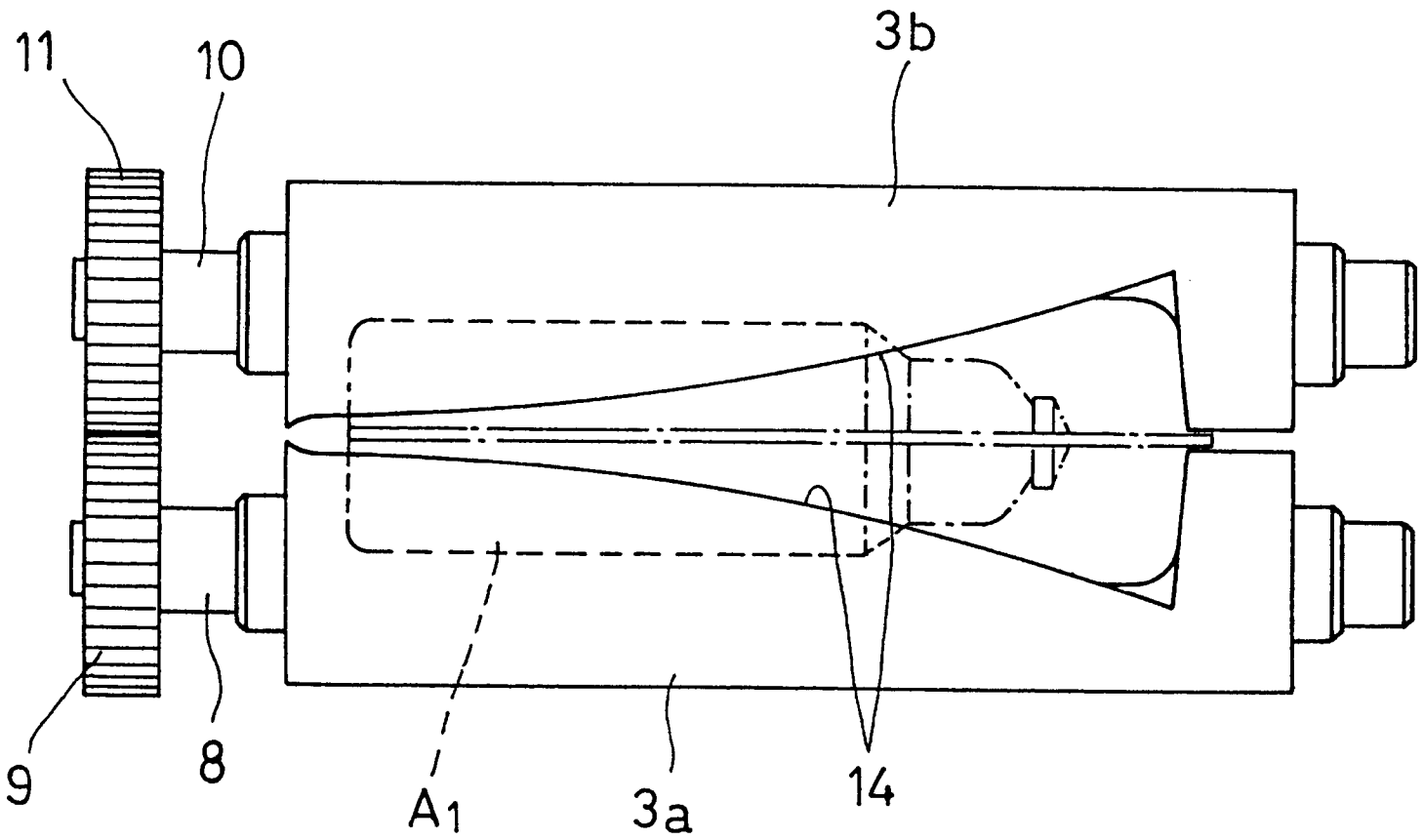
FIG. 6 is a plan view of FIG. 5.
Figure 7A:
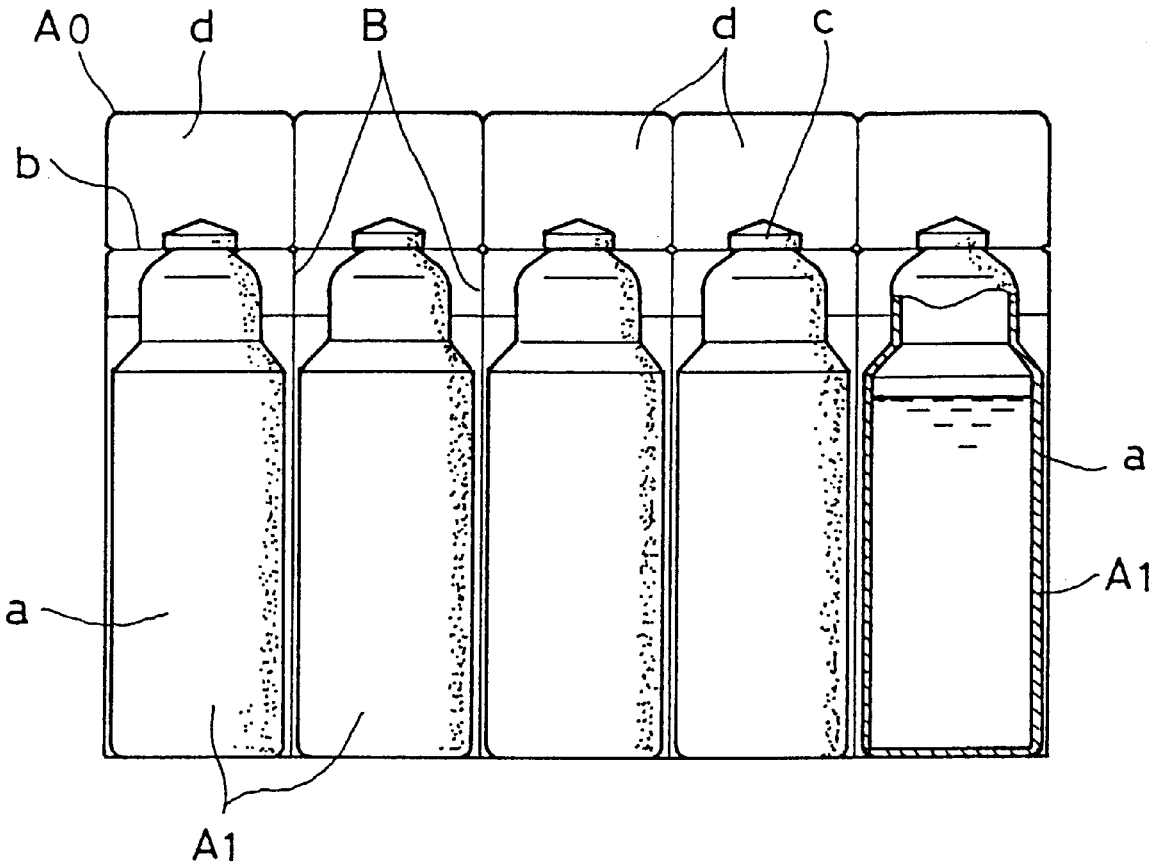
FIG. 7A is a front view of series-connected ampules.
Figure 7B:
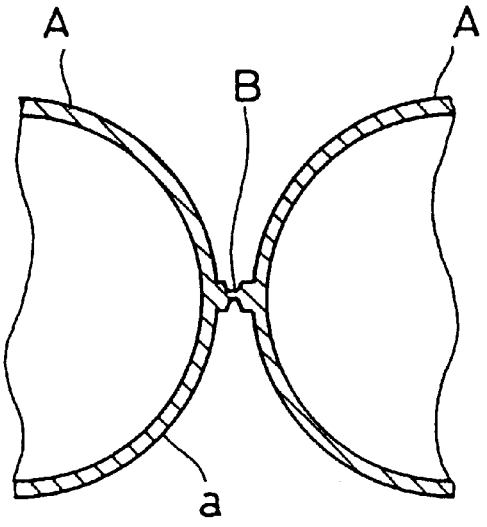
FIG. 7B is a sectional view of the connection between adjacent series-connected ampules.

FIGS. 4 to 6 show a different type of rotors 3*a*, 3*b*, which have their respective rear (relative to the rotating direction of the rotors) edges 14 twisted.

The twisting of the edges makes it possible to push down the body of the lowermost ampule A1, not at one time, but gradually from one toward the other end thereof during the cutting or seperating operation of an ampule A1 as shown in FIGS. 5 and 6.

Thus, even if the cutoff lines B are resistant to tearing, it is possible to reliably cut off an ampule along each cutoff line B with a smaller load. The small load feature prevents seizure of the motor 5 for rotating the rotors 3*a*, 3*b*.

In the embodiment of the invention, each plastic ampule strip A0 stored in the stocker 1 is discharged downward by gravity. Thus, there is no need to provide a feed means for feeding the ampule strip A0 toward the outlet 2. This simplifies the structure of the entire device.

The stocker 1 may be arranged so that ampule strips can be stored therein with the ampules arranged horizontally or obliquely. In this arrangement, each ampule strip is fed toward the outlet by a feed device to cut off plastic ampules one by one with a pair of rotors 3*a*, 3*b* provided at the outlet. While the ampule at the leading end of the strip is being cut by a pair of rotors 3*a*, 3*b* provided at the outlet, the following ampules A1 may be supported by the cylindrical outer surfaces 13 of the rotors 3*a*, 3*b*.

As described above, according to this invention, a pair of rotors are provided at the outlet of a stocker. The rotors are formed with grooves which can receive part of a plastic ampule. The rotors are rotated in unison in opposite directions. It is thus possible to efficiently separate each strip of series-connected plastic ampules into individual ampules. While the ampule at the leading end of the strip is being cut off, downward movement of the following ampules is stopped by the rotors. That is, the rotors function both as a cutter and a stopper. It is thus not necessary to provide a separate stopper means. This structure of the entire device is thus simple. The rotors can be controlled easily because they are simply rotated.

In the arrangement in which the rotors have their respective rear (relative to the rotating directions of the rotors) edges twisted, it is possible to push down the body of an ampule, not at one time, but gradually from one toward the other end thereof. Ampules can thus be cut off more reliably. Also, with this arrangement, it is possible to reduce the load on the motor and thus the possibility of seizure of the motor.

What is claimed is:

1. An ampule separator for separating a strip of series-connected plastic ampules along cut off lines provided between adjacent ampules, said ampule separator comprising:

a stocker for storing the strip of series-connected ampules, said stocker having an outlet;

a first rotor disposed adjacent said outlet, said first rotor having a cylindrical outer peripheral surface and a first groove, wherein said first groove has a first edge, which extends in a direction along a longitudinal axis of said first rotor, and a second edge, and said cylindrical outer peripheral surface extends outside of said first groove continuously between said first and second edges of said first groove;

a second rotor disposed adjacent said outlet such that a longitudinal axis of said second rotor is parallel to said longitudinal axis of said first rotor, said second rotor having a cylindrical outer peripheral surface and a second groove, wherein said second groove has a first edge, which extends in a direction along a longitudinal axis of said second rotor, and a second edge, and said cylindrical outer peripheral surface extends outside of said second groove continuously between said first and second edges of said second groove; and a drive means for rotating said first and second rotors in opposite directions such that said first and second rotors are always in phase with each other.

2. The ampule separator as claimed in claim 1, wherein:

said second edge of said first groove extends along a generally spiral path relative to said longitudinal axis of said first rotor; and said second edge of said second groove extends along a generally spiral path relative to said longitudinal axis of said second rotor.

3. The ampule separator as claimed in claim 1, wherein with each rotation of said first and second rotors, said first and second grooves forms a recess for receiving and separating a leading ampule from the strip of series-connected plastic ampules.

4. The ampule separator as claimed in claim 1, wherein:

each of said first edges of said first and second grooves extends along a linear path; and said second edges of said first and second grooves are oriented relative to said first edges so that, upon rotation of said first and second rotors, said second edges are pressed against a leading plastic ampule of the strip of series-connected plastic ampules, and the pressing force applied by said second edges will act at one point of the cut off line between the leading plastic ampule and a succeeding plastic ampule, and separation between the leading plastic ampule and the succeeding plastic ampule will initiate at said one point in order to cut off the leading plastic ampule.

5. An apparatus comprising:

a stocker having an outlet formed in a lower portion of said stocker;

a strip of series-connected ampules accommodated in said stocker such that said plastic ampules are guided through said stocker in a horizontal orientation toward said stocker outlet, wherein said strip includes cut off lines between adjacent ampules;

a pair of parallel rotors disposed in a horizontal orientation adjacent said outlet, each of said rotors having a cylindrical outer peripheral surface and a groove, wherein each of said grooves has a first edge and a second edge which is circumferentially spaced from said first edge, and each of said cylindrical surfaces extends continuously outside of a respective one of said grooves between said first and second edges thereof; and a drive mechanism for rotating said rotors in opposite directions such that said first and second rotors are always in phase with each other so that said grooves form a recess receiving a leading ampule of said strip of series-connected ampules and, upon further rotation of said rotors, said second edges push down on said leading ampule while said cylindrical outer peripheral surfaces support a succeeding ampule of said strip of series-connected ampules.

6. The separator as claimed in claim 5, wherein said second edges of said grooves extend in a direction away from said first edges of said grooves, respectively.

7. The separator as claimed in claim 5, wherein said first edges of said grooves extend along a linear path, and said second edges of said grooves extend along a non-linear path, such that each of said grooves has a width at one end of said rotors which is less than a width of said grooves at the other end of said rotors.

8. The separator as claimed in claim 5, wherein said second edges of said grooves extend along a generally spiral path relative to said longitudinal axis of said rotors, respectively.

* * * * *